United States Patent [19]

Lockard

[11] Patent Number: 4,602,830

[45] Date of Patent: Jul. 29, 1986

[54] DOUBLE ROW ELECTRICAL CONNECTOR

[75] Inventor: Joseph L. Lockard, Harrisburg, Pa.

[73] Assignee: AMP Incorporated, Harrisburg, Pa.

[21] Appl. No.: 652,777

[22] Filed: Sep. 20, 1984

[51] Int. Cl.[4] ..... H01R 4/66; H01R 13/504

[52] U.S. Cl. ..... 339/14 R; 339/176 M; 339/218 M; 339/221 M

[58] Field of Search ..... 339/176 MF, 218 R, 218 M, 339/221 R, 221 M, 176 M, 176 MP, 14 R, 17 F

[56] References Cited

U.S. PATENT DOCUMENTS

| | | | |
|---|---|---|---|
| 2,497,484 | 2/1950 | Wood | 339/221 R |
| 3,569,900 | 3/1971 | Uberbacher | 339/217 S X |
| 3,634,806 | 1/1972 | Fergusson | 339/176 MF X |
| 3,731,251 | 5/1973 | Sinclair | 339/176 MF X |
| 4,035,050 | 7/1977 | Volinskie | 339/176 MF X |
| 4,043,630 | 8/1977 | Suverison et al. | 339/218 M |
| 4,173,388 | 11/1979 | Brandeau | 339/278 C X |
| 4,293,177 | 10/1981 | Weisenburger | 339/176 MF X |
| 4,506,940 | 3/1985 | Asick et al. | 339/176 MF X |

FOREIGN PATENT DOCUMENTS

| | | | |
|---|---|---|---|
| 0063696 | 11/1982 | European Pat. Off. . | |
| 0112019 | 6/1984 | European Pat. Off. . | |
| 132164 | 8/1978 | German Democratic Rep. | 339/275 R |

*Primary Examiner*—Gil Weidenfeld
*Assistant Examiner*—Steven C. Bishop
*Attorney, Agent, or Firm*—Anton P. Ness

[57] ABSTRACT

A double row connector is provided having an upper row and a lower row of a signal contacts with spring arm contact sections thereof projecting forwardly thereof from horizontal body sections of contact members. The contact members also have vertical body sections extending vertically from a side of the horizontal body sections and secured in vertical slots of a dielectric spacer block, and the horizontal body sections of upper contacts are disposed adjacent the upper surface of the spacer, and those of lower contacts are disposed adjacent the lower surface. Vertical body sections of the upper and lower contacts alternate along the spacer. The upper subassembly thus formed is secured to an upper surface of a planar insert having a ground plane secured to its lower surface, comprising a lower subassembly to form a contact assembly. Signal conductors of trilead cables are welded to ferrules of signal contacts, which ferrules extend rearwardly from the signal contacts beyond the spacer and are aligned adjacent the planar insert. Ground conductors are welded to the ground plane. Upper ground contacts are similar to the upper signal contacts with contact sections and horizontal and vertical body sections and have tabs extending downward through the planar insert and the ground plane and are bent over, securing the upper subassembly to the lower subassembly and electrically engaging the ground plane. The entire assembly is overmolded with plastic to form an overmolded contact assembly and a forward housing member may be latchingly secured to the overmolded assembly. Contacts for use with the spacer are disclosed.

29 Claims, 10 Drawing Figures

DOUBLE ROW ELECTRICAL CONNECTOR

FIELD OF THE INVENTION

The present invention relates to the field of electrical connectors and, more particularly, to double row socket connectors.

BACKGROUND OF THE INVENTION

Double row socket connectors are known, for mating with double row pin connectors, which have two rows of single cantilever spring arms each of which electrically engages a respective pin. Certain of such double row socket connectors have the other ends of their socket contacts soldered to forward ends of conductors on side surfaces of an edge portion of a printed circuit board, which in turn has soldered to other conductor ends on an opposing edge portion, ends of individual signal and ground conductors of insulated cables; the printed circuit board and the cable ends are secured within a two-part premolded housing latchingly secured to the forward housing of the double row socket connector. It is seen as desirable to replace the total soldered printed circuit board/three-part housing assembly double row socket connector with a two-part housing connector having a double row of sockets whose contacts are directly electrically terminated to the respective signal and ground conductors of the cables, which cables are aligned in a single row and whose terminated sections are sealed.

SUMMARY OF THE INVENTION

The present invention is a double row socket connector having a contact assembly and a forward housing member having discrete socket cavities for mating with pins of a double row pin connector where the sockets each comprise a single cantilever spring contact arm and an opposing outer cavity wall of the forward housing. The cantilever spring contact arms are sections of discrete contact members secured in a contact assembly selected ones of which are electrically connected to either individual signal conductors of conductor cables, or to ground conductors thereof, preferably by laser welding. The signal and certain of the ground contact members have horizontal body sections forwardly from which extend the cantilever spring arm contact sections, and vertical body sections depending from sides of the horizontal body sections. The vertical body sections are secured within vertical slots of an insulating block with an upper row of signal contacts having their horizontal body sections disposed along the upper surface of the block and a lower row of signal contacts having their horizontal body sections disposed along the lower surface of the block. The contact sections extend forwardly of the block. An upper contact subassembly is thus formed.

Each signal contact member has a conductor-connecting section extending rearwardly from the block, with those sections of both upper and lower signal contacts having horizontal termination sections aligned in a single row. The horizontal termination sections are integrally joined to the vertical body sections of the signal contact members by a vertical web section extending from a lower rear corner of the vertical body sections. Certain ground contact members are also secured in vertical slots of the block similarly to the upper signal contact members, but have tab sections extending below the lower surface of the block.

The thus formed upper contact subassembly is mounted to a lower contact subassembly comprising a dielectric planar insert member and a ground plane mounted below the planar insert member, by inserting the tab sections of the upper ground contacts which project below the block, into corresponding slots through the planar insert member and the ground plane and then bending the tabs over against the ground plane, which also electrically connects the upper ground contacts with the ground plane. Several cantilever spring contact arms may extend forwardly from the ground plane to become lower ground contact sections, and these are raised from the plane of the ground plane by alignment sections to be aligned with the row of lower signal spring contact arms.

The planar insert member has a rearward conductor-positioning section having channels therein so that individual signal and ground conductors of electrical cables aligned in a single row may be positioned to be terminated to the termination sections of the contact members, with all signal conductors channeled to the upper surface of the planar insert where the horizontal termination sections of the signal contact members are aligned adjacent the upper surface, and all ground conductors channeled to the lower surface of the planar insert to be terminated to a conductor-connecting section at the rearward end of the ground plane. When the signal and ground conductors are terminated, the joined upper and lower contact subasseblies are overmolded sealingly with a dielectric material completely therearound except at the forward ends of both subassemblies such that the two rows of cantilever spring contact arms are exposed. The overmolded housing also extends rearward along portions of the electrical cables forming strain relief therefor, and also has latching features on the outer surface to latchingly engage the forward housing member which houses the forwardly-extending cantilever spring contact arms to complete the assembly of a double row socket connector.

DESCRIPTION OF THE PREFERRED EMBODIMENT

The double row socket connector of the present invention comprises a contact assembly having upper and lower contact subassemblies which after termination to stripped signal and ground conductors of trilead cables aligned in a single row is overmolded to provide a profiled, sealing insulator housing which is latchably securable within a forward housing member.

Figure 1:
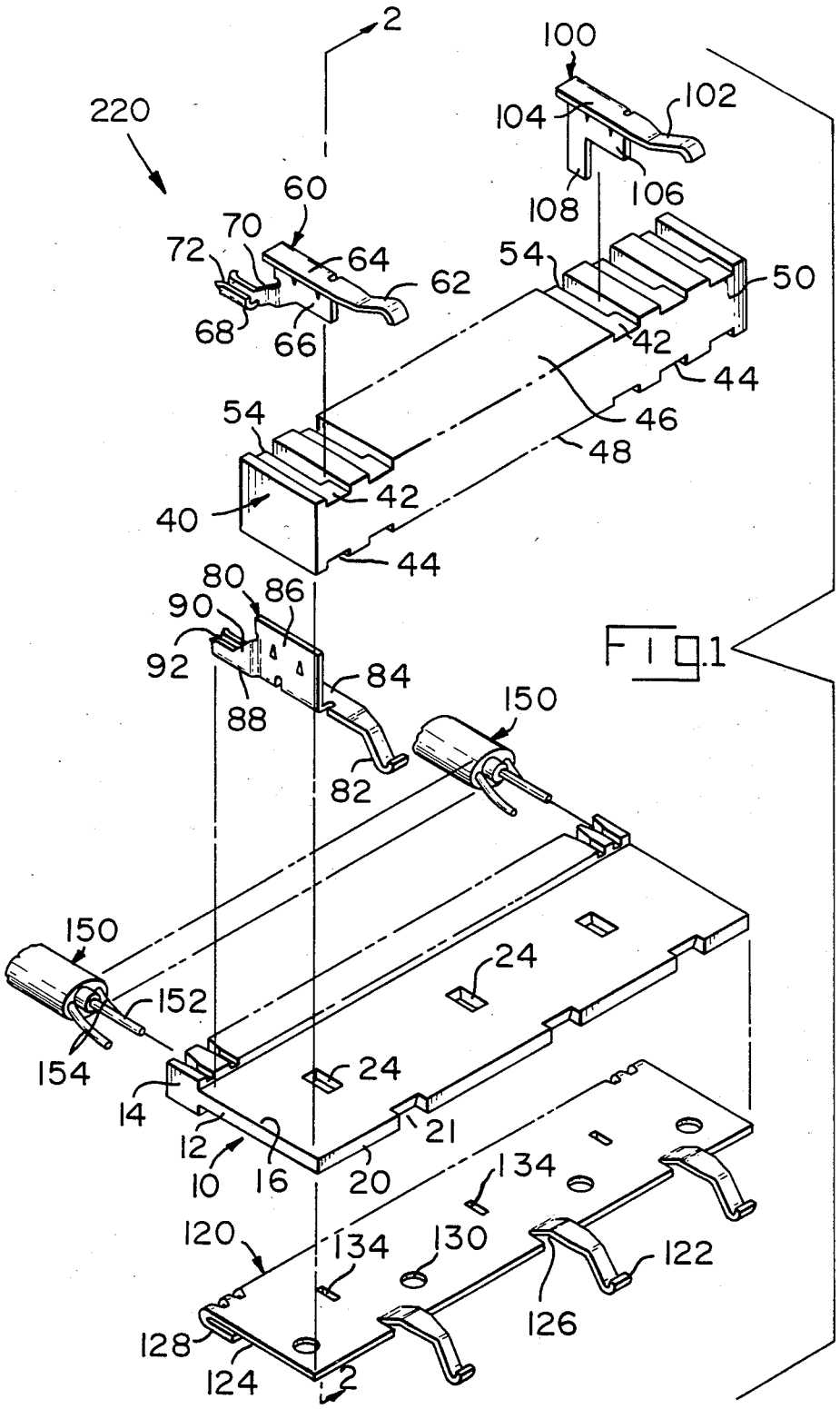
FIG. 1 is an exploded view of the contact assembly of the connector of the present invention showing representative contacts.

FIG. 1 illustrates the components comprising the contact assembly 220, which are planar insert member 10, insulator block 40, upper signal contacts 60, lower signal contacts 80, upper ground contacts 100, and ground plane 120. Also shown are representative trilead cables 150 each having a signal conductor 152 and two ground conductors 154.

Contacts 60, 80, 100 have forward spring contact sections 62, 82, 102 respectively extending forwardly from horizontal body sections 64, 84, 104 and vertical body sections 66, 86, 106 depending each from a longitudinal side of sections 64, 84, 104 respectively, forming L-shapes. Each upper signal contact 60 has a conductor-receiving section 68 comprising an intermediate vertical web section 70 and a horizontal terminating section 72. Web section 70 extends integrally from the edges of the rearward lower corner portion of vertical body section 66 diagonally downwardly and rearwardly therefrom. Each lower signal contact 80 has a conductor-receiving section 88 comprising an intermediate vertical web section 90 and a horizontal terminating section 92, and web section 90 extends integrally rearwardly from the rearward edge of vertical body section 86. Each upper ground contact 100 has a tab section 108 depending from verical body section 106. Contacts 60, 80, 100 are preferably stamped and formed of copper alloy as is ground plane 120, and forward spring contact sections 62, 82, 102, 122 may be gold-plated at contact engagement surfaces thereof.

Figure 2:
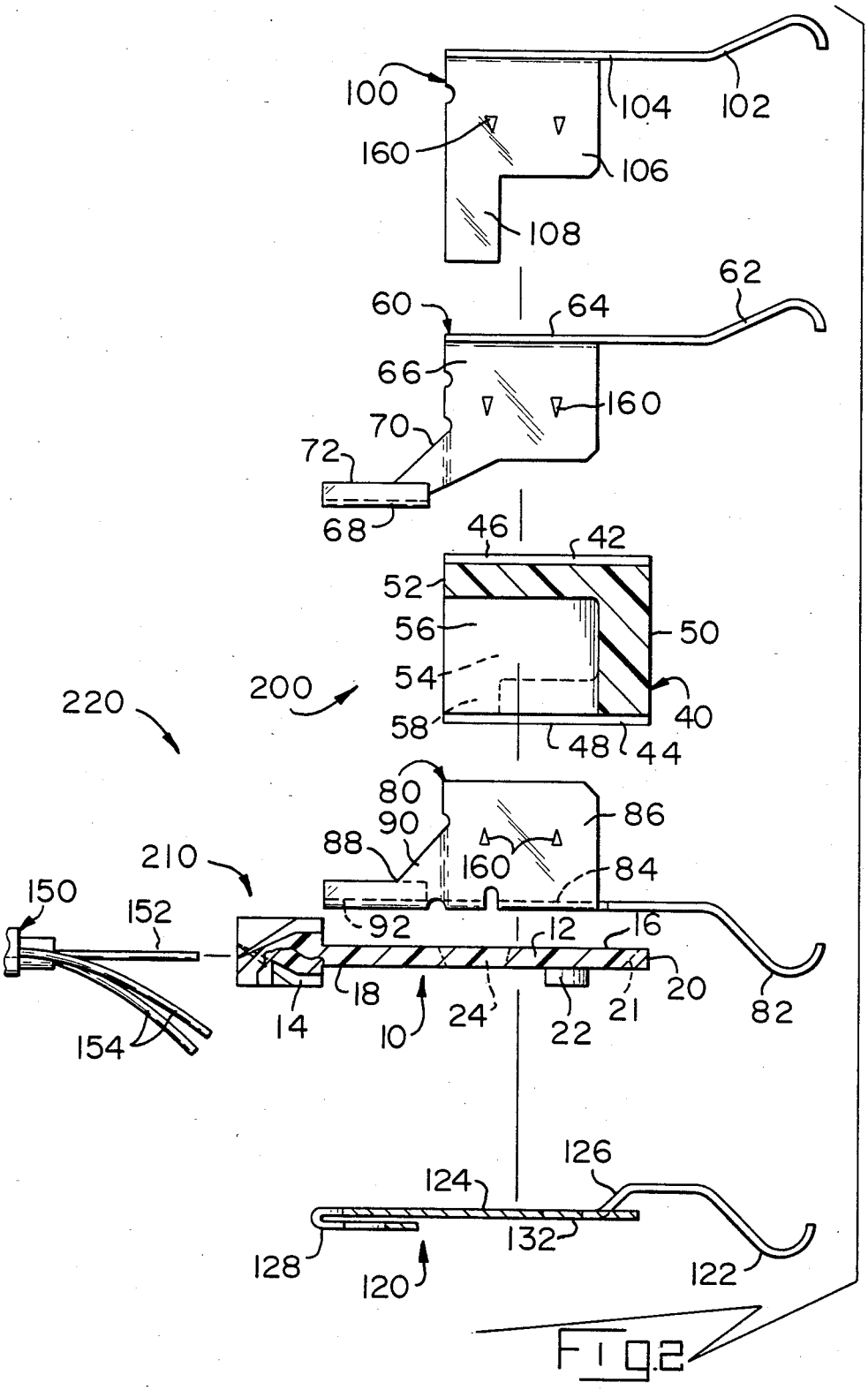
FIG. 2 is an exploded longitudinal section view taken along line 2-2 of FIG. 1.

Insulator block 40 is molded of dielectric preferably plastic material such as fluoropolymer or polyester and serves as a contact-receiving member to space, align and retain contacts 60, 80, 100 securely therewithin. With reference to FIGS. 1 and 2, opposing pairs of recesses 42, 44 in top and bottom surfaces 46, 48 respectively of block 40 extend in parallel from forward block surface 50 to rearward block surface 52 and serve to contain horizontal body sections 64, 84, 104 of the contacts. Upper contact-receiving slots 54 extend in parallel deeply into block 40 from top surface 46 and rearward surface 52 and communicate with a selected side of upper recesses 42; each of upper slots 54 also has a lower portion 58 which communicates with a side of an associated lower recess 44 for a distance inward from rearward block surface 52. Alternated and parallel therewith and spaced therefrom are lower contact-receiving slots 56 which extend in parallel deeply into block 40 from bottom surface 48 and rearward surface 52 and communicate with a selected side of lower recesses 44, which side is opposite from the selected side of upper recesses 42.

An upper contact subassembly 200 is formed when upper slots 54 receive vertical body sections of upper contacts 60, 100 and lower slots 56 receive vertical body sections of lower contacts 80 respectively, which contacts are held in the slots by means such as barbed projections 160 which resist removal of the contacts from the slots by tending to dig into one or the other of the sides of the slots. Spring contact sections 62, 82, 102 extend forwardly beyond forward block surface 50 such that sections 62, 102 are aligned with each other, and sections 82 are aligned with each other. Conductor-receiving sections 68, 88 extend rearwardly from rearward block surface 52 such that horizontal terminating sections 71, 92 are aligned in parallel with each other, alternating with and generally equidistant from each other. A part of each verticl web section 70 may extend downwardly through lower portion 58 of a respective upper slot 54.

Upper ground contacts 100 are secured in associated upper slots 54 such that tab sections 108 of upper ground contacts 100 extend through lower portions 58 outwardly and below bottom block surface 48. Tab sections 108 will later serve to affix upper contact subassembly 200 to lower contact subassembly 210.

Lower contact subassembly 210 consists of planar insert member 10 of dielectric material such as a fluoropolymer or polyester plastic, and ground plane 120 secured therebeneath. Planar insert member 10 has a thin, planar forward portion 12 and a thicker, short conductor-positioning section 14 rearwardly thereof, with forward insert portion 12 having a flat upper surface 16, a substantially flat lower surface 18 and a forward end surface 20. Ground plane 120 has several spring contact sections 122 extending forwardly from planar body section 124 and integrally connected thereto by alignment sections 126, and a conductor-receiving section 128 extending rearwardly from body section 124.

Figure 3:
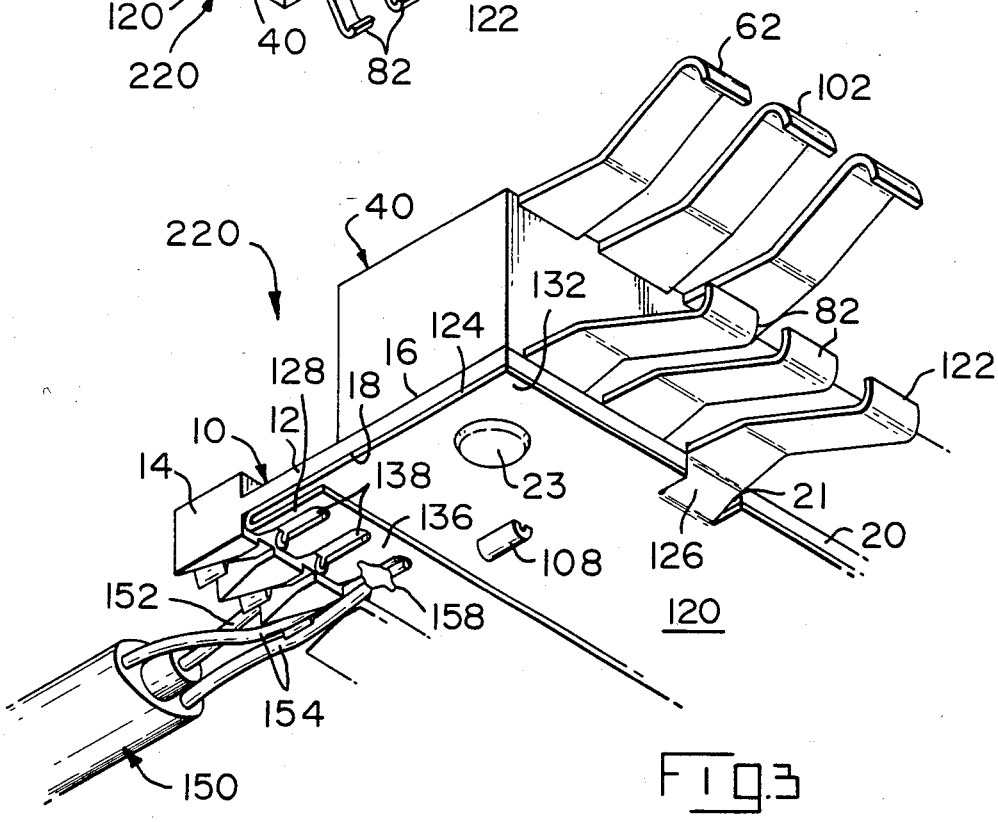
FIG. 3 is a perspective view from below of the upper and lower contact subassemblies.

As shown best in FIG. 3, ground plane 120 is affixed to lower insert surface 18 to form a lower contact subassembly 210. Preferably, projections 22 depend from lower insert surface 18 downwardly through corresponding holes 130 in ground plane body section 124, as shown in FIG. 3. Projections 22 are then staked such as by cold staking to deform lower ends thereof by widening them along bottom surface 132 of ground plane 120 to form enlarged, flattened heads 23 which serve to secure ground plane 120 to planar insert 10. Alternatively, heat staking may be used.

Each spring contact section 122 of ground plane 120 extends forwardly of forward insert end surface 20. Each alignment section 126 slopes upwardly from body section 124, extending into recesses 21 spaced laterally along forward insert end surface 20 such that spring contact sections 122 will be in alignment with spring contact sections 82 of lower signal contacts 80 after upper contact subassembly 200 has been affixed to lower contact subassembly 210. Conductor-receiving section 128 is disposed adjacent lower insert surface 18 just forwardly of conductor-positioning section 14.

As are best seen in FIG. 1, tab slots 24 extend vertically through planar forward insert portion 12 and are spaced laterally therealong located a preselected distance forwardly of conductor-positioning section 14, and are of a length and position to correspondly receive tab sections 108 extending downwardly from upper contact subassembly 200, and tab slots 24 preferably have beveled lead-in surfaces. Extending through body section 124 of ground plane 120 are tab slots 134 aligned with tab slots 24.

As shown in FIG. 3, upper contact subassembly 200 is affixed to lower contact subassembly 210 to form contact assembly 220, by means of tab sections 108 being inserted into respective tab slots 24, 134 and being bent sideways against bottom ground plane surface 132, which also serves to establish electrical engagement between upper ground contacts 100 and ground plane 120. Contact assembly 220 is illustrated in FIG. 4.

Figure 4:
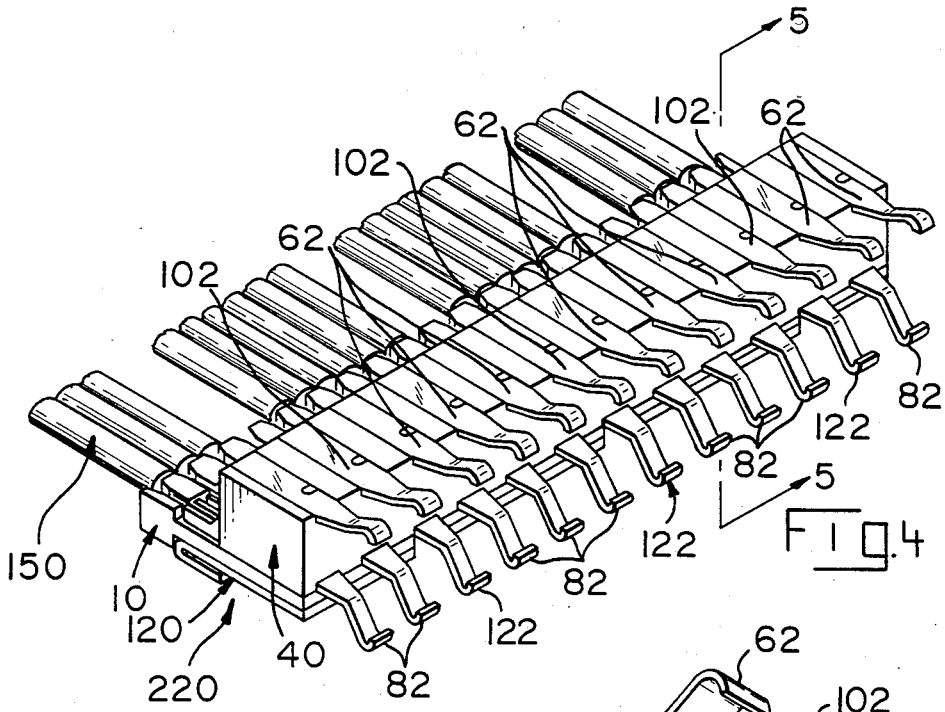
FIG. 4 is a perspective view of the contact assembly of FIG. 1.

With reference to FIG. 4, in this particular embodiment, there are three upper ground contacts 100, spaced one centrally and one near each side of insulator block 40. There are three spaced spring contact sections 122 of ground plane 120 which need not correspond with spring contact sections 102 of upper ground contacts 100. No conductor cables 150 will be positioned in any such locations for termination to contact assembly 220, because no signal contacts are positioned at these locations.

Figure 5:
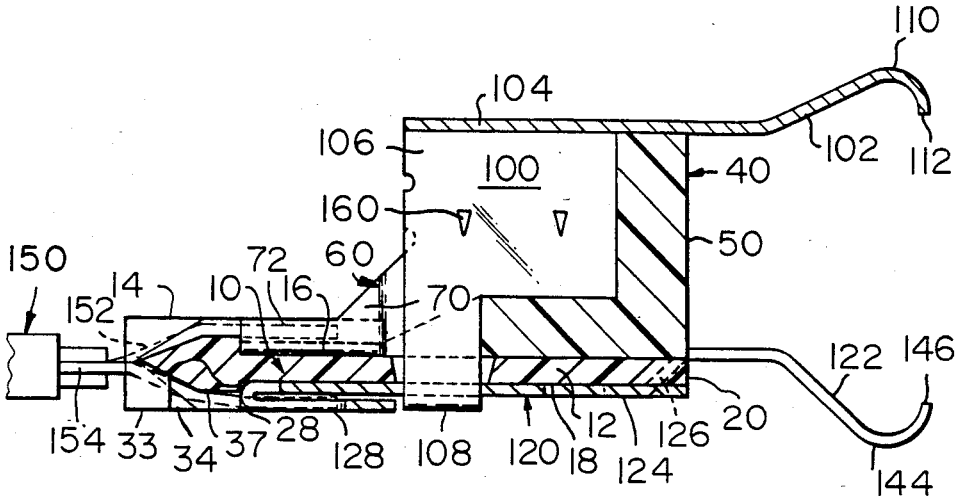
FIG. 5 is a longitudinal section view of the contact assembly taken along line 5—5 of FIG. 4.

It can be seen in FIGS. 4 and 5 that contact assembly 220 has preferably a coplanar forward surface comprising forward block surface 50, forward insert end surface 20 and the forward edge of body section 124 of ground plane 120. Spring contact sections 82, 122 of lower signal ground contact 80 and ground plane 120 are in alignment. Horizontal termination sections 72, 92 of signal contacts 60,80 are disposed adjacent upper insert surface 16 and just forwardly of conductor-positioning section 14, while opposed therefrom along lower insert surface 18 is conductor-receiving section 128 of ground plane 120.

Figure 6:
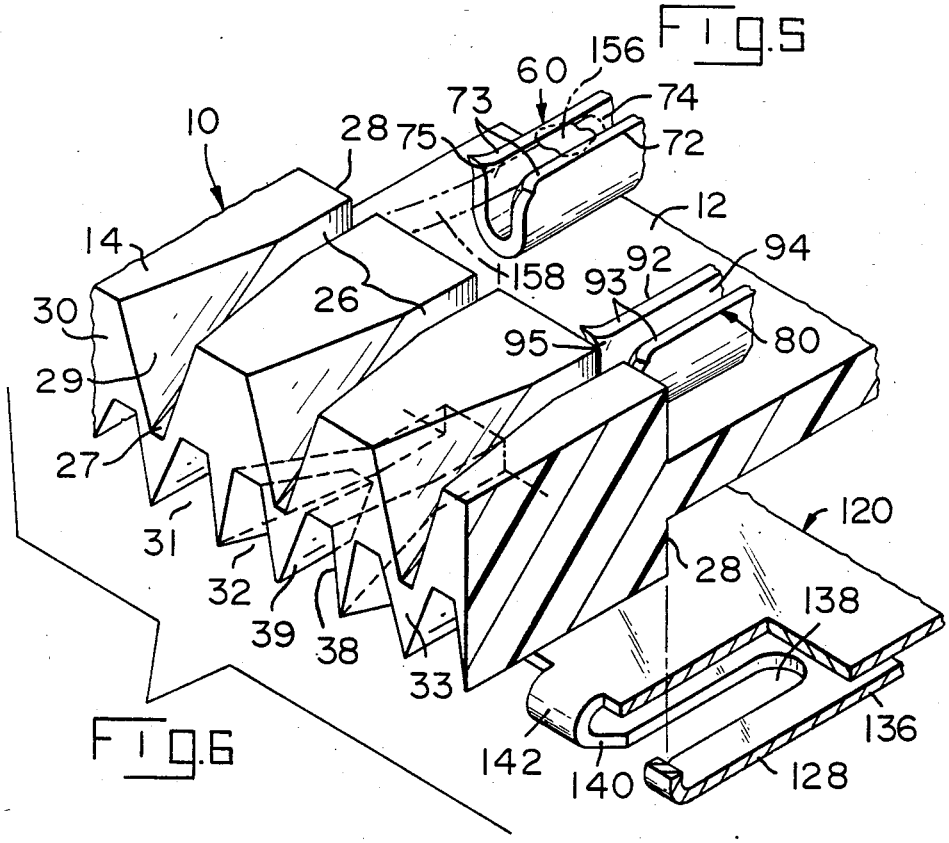
FIG. 6 is an enlarged perspective view of the conductor-positioning section of the planar insert member from rearward thereof.

As shown in detail in FIG. 6, conductor-positioning section 14 has a geometry which is preferred in order to facilitate automated assemblly and termination. The upper surface thereof has an upper or signal channel 26 associated with each conductor cable 150. Preferably, channel bottom surface 27 first gradually inclines for a selected distance, then extends horizontally forwardly to an upper portion of forward end surface 28 of conductor-positioning section 14. Each upper channel 26 preferably is slightly wider than the diameter of a stripped signal conductor 152 of a cable 150 to be disposed therein and has a lead-in 29 formed by chamfered surfaces proximate rearward insert end 30.

Each conductor cable 150 also has a pair of associated lower or ground channels 31, 32 for receiving each of the two ground conductors 154 thereof, as seen in FIGS. 3 and 6. Paired ground channels 31, 32 are preferably separated at rearward insert end 30 by pyramidal land 33, then extend forwardly therefrom to converge into a single wide lower channel 34 which extends forwardly to a lower portion of forward end surface 28 of conductor-positioning section 14. Ground channels 31, 32 have declining channel bottoms 35, 36, that is, which proceed downwardly towards a lower outer surface of section 14 until converging, and then horizontally forwardlly therefrom in a single wide channel bottom 37 essentially opposed from a corresponding signal channel 26 thereabove. Ground channels 31, 32 preferably have chamfered lead-ins 38, 39. Alternatively, a single lower channel may be provided for each pair of ground conductors 154 which has a wide chamfered lead-in and no pyramidal land.

All horizontal terminating sections 72, 92 are aligned with upper channels 26 just forwardly of end surface 28 of section 14 such that each stripped signal conductor 152 may be disposed along channel bottom 27 of an associated upper channel 26 and securable to an associated horizontal terminating section 72 or 92 such as by crimping, soldering or welding. Similarly, both ground conductors 154 of each cable 150 from both sides of the cable's insulated signal conductor may be slightly angled toward each other to enter angled lead-ins 38, 39 of associated paired lower channels 31, 32, extend along channel bottom 35, 36 thereof, and then along channel bottom 37 of single lower channel 34, and be securable to conductor-receiving section 128 of ground plane 120.

It is preferred that the teachings of U.S. Pat. application Ser. No. 536,017 filed Sept. 26, 1983, now abandoned, and of U.S. patent application Ser. No. 652,778 filed Sept. 20, 1984, both assigned to the assignee hereof, be followed regarding the termination of signal and ground conductors to respective contacts, and those teachings are incorporated herein by reference.

Horizontal terminating sections 72, 92 of signal contact 60, 80 preferably are ferrules each having sidewalls 73, 93 defining a longitudinal groove 74, 94 therebetween formed therein within which a signal conductor 152 is disposed and preferably welded, and most preferably, laser welded. For laser welding it is preferred that each conductor 152 be secured in interference fit proximate the top of groove 74, 94, such as is shown in FIG. 6, and welded at weld 156. Grooves 74, 94 need only have a depth equal to half the diameter of conductors 152; deeper grooves 74, 94 as shown may have sidewalls 73, 93 spaced a width apart just less than the diameter of a conductor 152 and act with slight spring action to retain conductor 152 therein in interference fit proximate the top edges thereof for laser welding, with the conductor wiped thereinto forwardly from rearward lead-in 75, 95 by tooling (not shown).

Conductor-receiving section 128 of ground plane 120 is preferably bent- or doubled-back with a bent-back portion 136 having a plurality of longitudinal slots 138 extending forwardly a selected distance therealong from lead-in openings 140 at the rearward end 142 of conductor-receiving section 128. Each slot 138 is aligned with an associated single lower channel 34 and is of a width such that both ground conductors 154 of a cable 150 may be disposed along associated lower channels 31, 32, 34 and an associated slot 138 to be, preferably, welded, and most preferably, laser welded at weld 158, as shown in FIG. 3. Each slot 138 for laser welding preferably is just wide enough so that the pair of ground conductors 154 are retained therein side-by-side in interference fit proximate the lower surface of bent-back portion 136. Preferably, bent-back portion 136 is substantially adjacent the bottom surface of ground plane 120.

Figure 7:
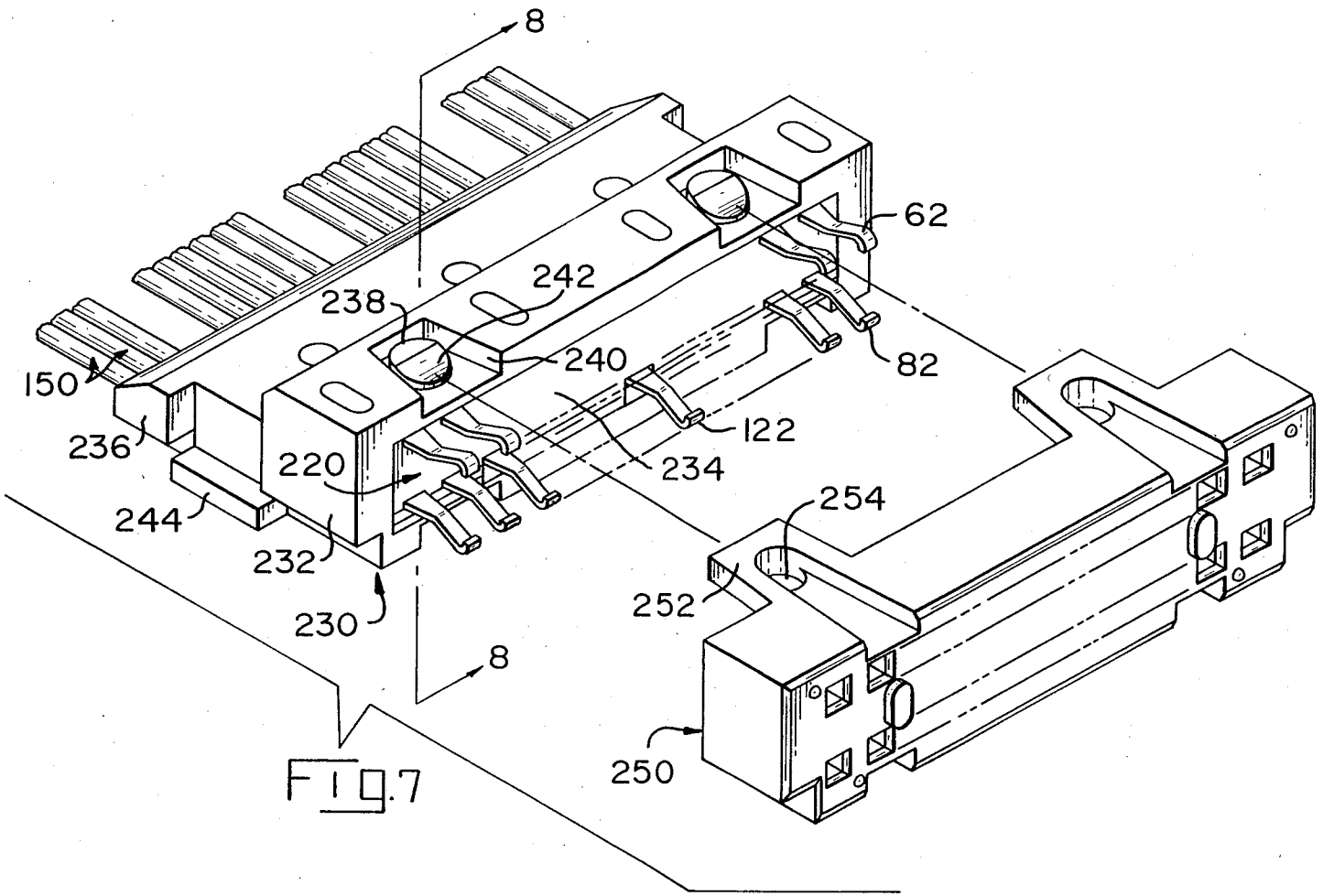
FIG. 7 is a perspective view of the overmolded contact assembly of FIG. 4 prepared to be inserted into a forward housing.
Figure 8:
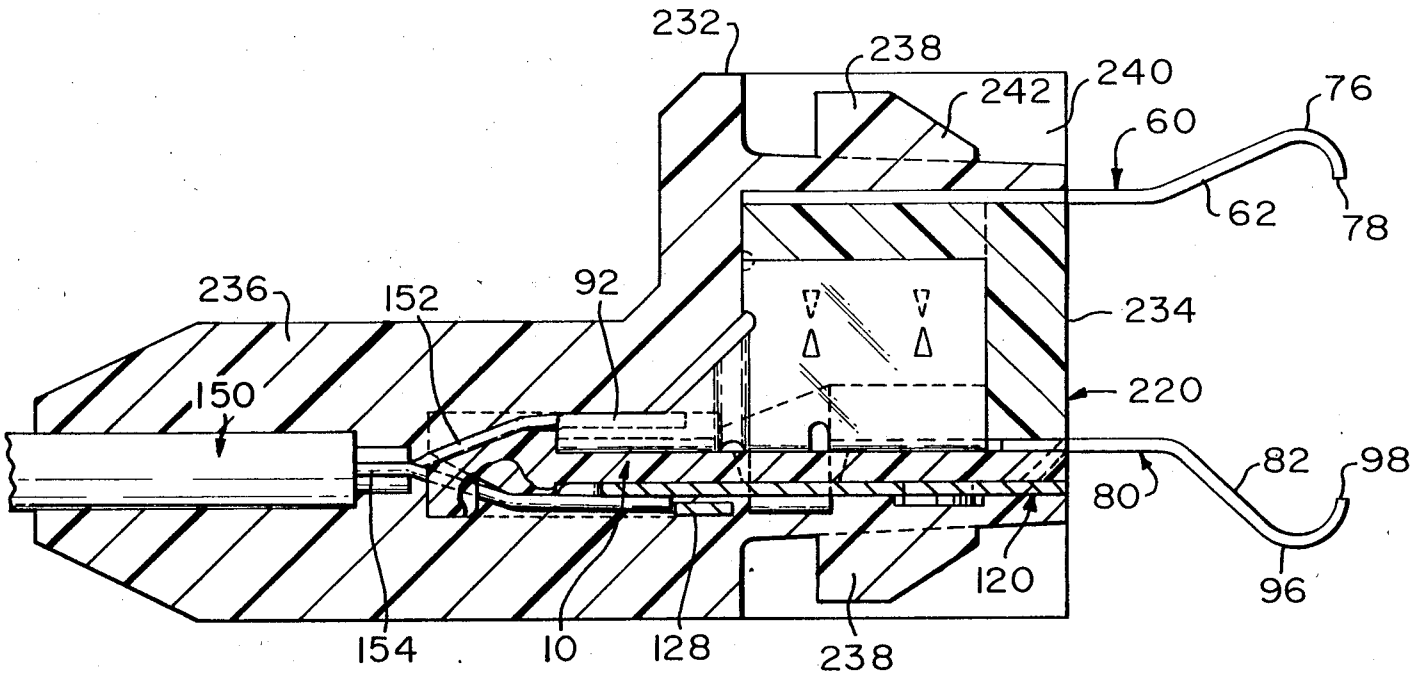
FIG. 8 is a longitudinal section view of the overmolded contact assembly of FIG. 7 taken along line 8—8.

Referring now to FIG. 7, with conductor cables 150 now terminated to respective contacts in contact assembly 220, contact assembly 220 now is preferably overmolded with dielectric plastic material such as polypropylene to form an overmolded assembly 230 which is profiled, as shown in FIGS. 7 and 8. An overmolded housing 232 is formed sealingly surrounding contact assembly 220 on five of six sides, excepting only the forward coplanar surface 234 from which extend spring contact arms 62, 82, 102, 122. Strain relief section 236 of housing 232 sealingly secures end portions 156 of cables 150, as well as signal and ground conductors 152 and 154 and the terminations thereof to the signal and ground contact termination sections 72, 92 and 128 respectively.

Figure 9:
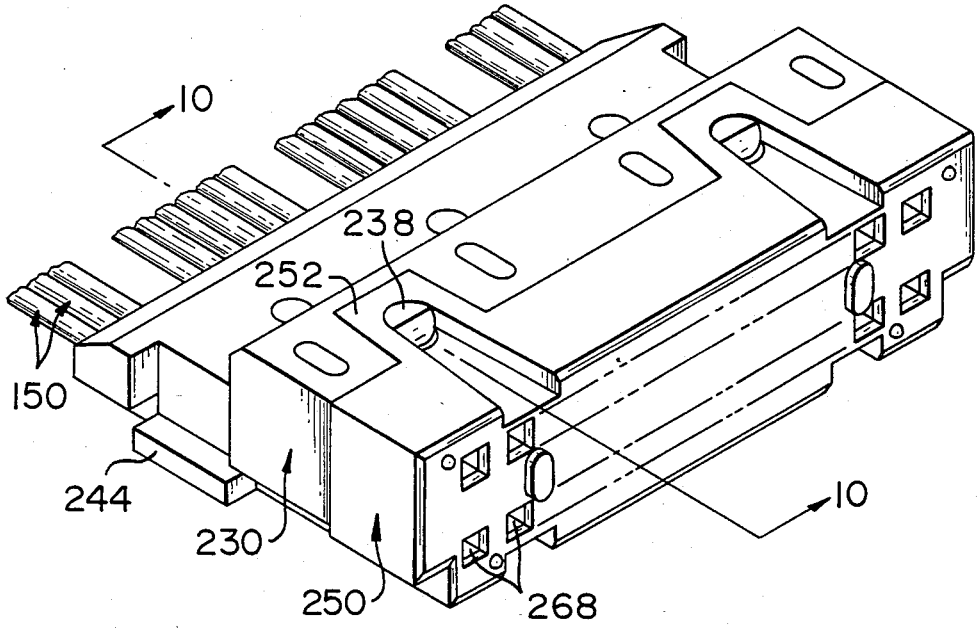
FIG. 9 is a perspective view of the assembled connector of the invention.

Latching projections 238 are molded in recesses 240 of upper and lower surfaces of overmolded housing 232, for latching to corresponding latching means 252 of a forward housing member 250. Latching projections 238 have beveled surfaces 242 to facilitate latching with resilient latching means 252 which ride over beveled surfaces 242 until latching projections 238 enter holes 254 in the latching means 252, at which time latching occurs, as seen in FIG. 9.

As seen in FIG. 8, upper spring contact arms 62, 102 normally when unbiased extend upwardly to contact sufaces 76, 110 and then have ends 78, 112 which curve downwardly. Similarly lower spring contact arms 82, 122 normally when unbiased extend downwardly to contact surfaces 96, 144 and then have ends 98, 146 which curve upwardly.

Figure 10:
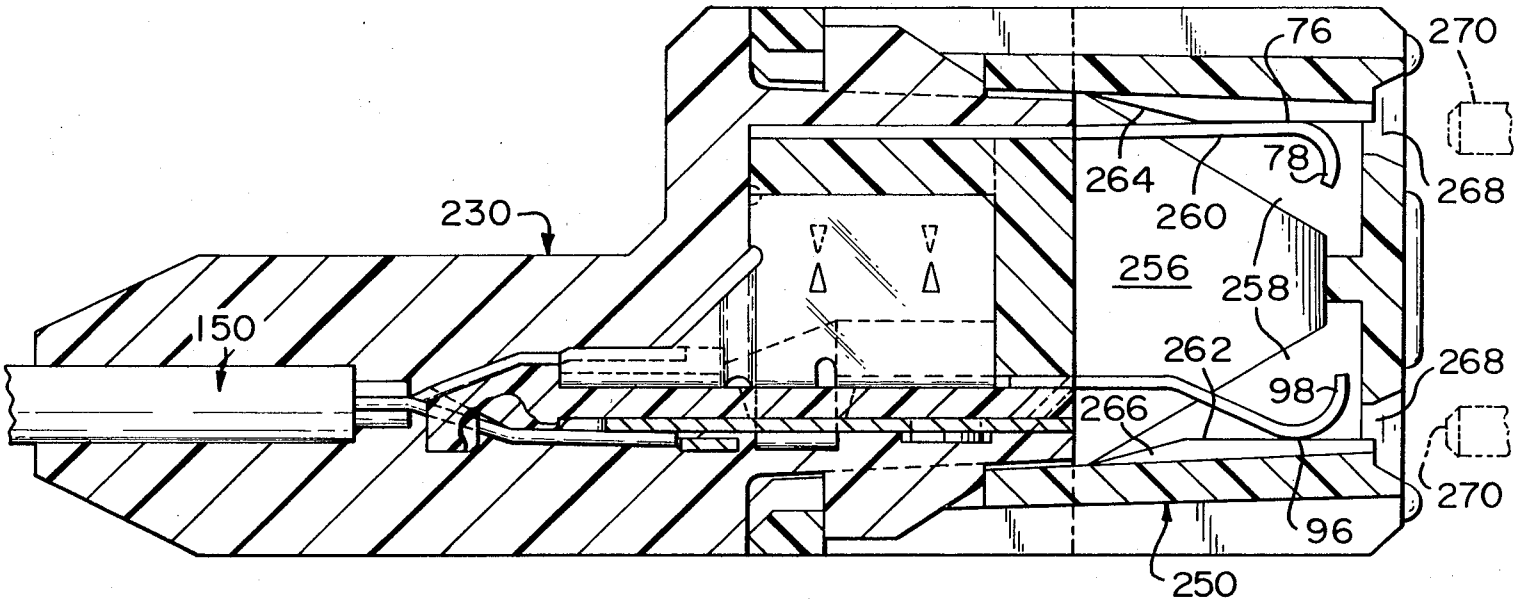
FIG. 10 is a longitudinal section view of the connector of FIG. 9 taken along line 10—10.

Referring now to FIG. 10, a completed connector is formed by the latching of forward housing member 250 with overmolded assembly 230. Opposing pairs of spring contact sections 62, 82, 102, 122 first enter large cavity 256 of housing 250 and then vertical cavities 258 having upper and lower cooperating surfaces 260, 262 respectively which are beveled at 264, 266 respectively. Curved ends 78, 112 of upper spring contact arms 62, 102 first engage beveled surfaces 264 and are urged downward thereby, and eventually the contact surfaces 76, 220 are in spring biased engagement cooperating against surfaces 260. Similarly, curved ends 98, 146 of lower spring contact arms 82, 122 first engage beveled surfaces 266 and are urged upward thereby, and eventually the contact surfaces 96, 144 are in spring biased engagement against cooperating surfaces 262.

Forward housing member 250 has openings 268 in communication with the top and bottom of verical cavities 258 proximate and aligned with spring contact arms now disposed therein. Pin contacts 270 of a mating electrical connector (not shown) are insertably received into openings 268 which engage the curved ends of the spring contact arms and urge the spring contact arms farther away from cooperating surfaces 260, 262. The spring bias force of the spring contact arms against the pin contacts 270 is the contact force. Guide keys 244 (FIG. 9) may be overmolded onto the outer surface of assembly 230 to assist proper mating alignment with a mating pin connector having corresponding keying channels.

Variations in the structure and assembling of the double row socket connector of the present invention may be made without departing from the spirit of the invention and the scope of the claims. In particular, the locations and numbers of the upper ground contacts may vary as well as the number and locations of the lower ground contact sections of the ground plane. A different number of cables may be used, and even trilead ribbon cable is foreseeable for use with the present invention.

What is claimed is:

1. A double row connector for being terminated to a single row of signal and ground conductor means of electrical cable means, comprising:

a first row of contact members and a second row of contact members;

a dielectric spacing means to which are secured said contact members, said spacing means having an upper surface adjacent to which are horizontal body sections of said contact members of said first row and a lower parallel surface adjacent to which are horizontal body sections of said contact members of said second row;

spaced vertical slots in said dielectric spacing means within which are secured vertical body sections of said contact members each of which vertical body sections extends integrally from a selected side of each of said horizontal body sections, said vertical slots being in communication with a rearward surface of said dielectric spacing means, alternating ones of said vertical slots extending from said upper surface toward said lower surface and from said lower surface toward said upper surface;

each of said contact members having a spring arm contact section extending integrally forwardly from said horizontal body section thereof and extending forwardly of a forward surface of said dielectric spacing means;

conductor-connecting sections of selected ones of said contact members extending in parallel alignment rearwardly from said dielectric spacing means to be terminated to selected ones of said conductor means, each said conductor-connecting section extending integrally rearwardly from a lower rearward portion of said vertical body section of each of said selected ones of said contact members;

a dielectric planar member having a conductor-positioning portion rearwardly thereof and a body portion forwardly thereof having an upper surface and a lower surface such that said dielectric spacer means containing said contact members secured therewithin is securable to said upper surface of said planar member such that said aligned conductor-connecting sections of said selected ones of said contact members are disposed adjacent said upper surface just forwardly of said conductor-positioning portion of said planar member, and said conductor means are disposed along said conductor-positioning portion from rearwardly thereof and are terminated to respective said conductor-connecting sections;

a dielectric housing means sealingly secured to selected portions of end lengths of said conductor means, said planar member, said spacing means and said contact members, said selected portion including said conductor-positioning portion of said planar member, terminations of said conductor means to said conductor-connecting sections, said rearward, upper and lower surfaces of said spacing means, and said horizontal body sections of said contact members, such that said spring arm contact sections extend forwardly from said dielectric housing means; and a dielectric forward housing member latchingly secured to latching means on said dielectric housing means and housing said spring arm contact sections to matingly engage with a matable double row connecting means.

2. A double row connector as set forth in claim 1 wherein said forward housing member houses said spring arm contact sections within discrete cavities to form sockets receiving corresponding pin contacts extending forwardly from a matable double row pin connector.

3. A double row connector as set forth in claim 1 wherein a ground plane is secured adjacent said lower surface of said planar member, said ground plane having a conductor-connecting section rearward thereof to which are terminated ground conductors of said electrical cable means, a body section and at least one spring arm contact section extending integrally forwardly from said body section and upwardly into alignment with said spring arm contact sections of said contact members of said second row, and said dielectric housing means extending sealingly around said conductor-connecting section and said body section of said ground plane.

4. A double row connector as set forth in claim 3 wherein tab sections of selected others of said contact members of said first row extend below said lower surface of said dielectric spacing means, each said tab section extending integrally from a lower edge of each of said vertical body sections of said selected others of said contact members, through a portion of an associated said vertical slot in communication with said lower surface of said spacer means, said tab sections extending through associated slots of said planar member and said ground plane and are bent over against a surface of said ground plane, securing said spacing means to said planar member and electrically connecting said selected others of said contact members to said ground plane.

5. A double row connector as set forth in claim 3 wherein projections extend from said lower surface of said planar member through corresponding holes in said body section of said ground plane and have enlarged heads formed thereon securing said ground plane to said planar member.

6. A double row connector as set forth in claim 3 wherein said at least one spring arm contact section of said ground plane extends upwardly through a corresponding recess in a forward end of said body portion of said planar member.

7. A double row connector as set forth in claim 1 wherein said conductor-positioning portion of said planar member includes channels extending along an upper surface thereof forwardly from a rearward end thereof to and aligned with said conductor-connecting sections of respective selected ones of said contact members along which respective conductors are disposed.

8. A double row connector as set forth in claim 3 wherein said conductor-positioning portion of said planar member includes channels extending along a lower surface thereof forwardly from a rearward end thereof and aligned with said conductor-connecting section of said ground plane along which respective ground conductors are disposed.

9. A double row connector as set forth in claim 3 wherein ones of said conductors are signal conductors terminated to said selected ones of said contact members, and others of said conductors are ground conductors terminated to said ground plane.

10. A double row connector as set forth in claim 9 wherein said signal conductors are disposed in a conductor cable, and pairs of said ground conductors are associated with each said signal conductor and disposed along respective ground conductor channel means extending along a lower surface of said conductor-positioning portion forwardly to said conductor-connecting section of said ground plane.

11. A double row connector as set forth in claim 10 wherein each said ground conductor channel means comprises a pair of adjacent rearward channel portions extending forwardly and converging into a single forward channel portion.

12. A double row connector as set forth in claim 10 wherein each said signal conductor and each said associated pair of ground conductors are disposed in a discrete trilead cable.

13. A double row connector as set forth in claim 1 wherein said conductors are terminated to said selected ones of said contact members by welding.

14. A double row connector as set forth in claim 1 wherein said conductor means are terminated to said selected ones of said contact members by laser welding.

15. A double row connector as set forth in claim 3 wherein said ground conductors are terminated to said ground plane by welding.

16. A double row connector as set forth in claim 3 wherein said ground conductors are terminated to said ground plane by laser welding.

17. A contact spacing means to space two rows of spring arm contact sections in a double row connector comprising a block of dielectric material having opposing, substantially parallel upper and lower surfaces and opposing, substantially parallel forward and rearward surfaces substantially normal to said upper and lower surfaces, said block having vertical spaced slots therein, selected ones of said slots extending downward from said upper surface and selected others said slots extending upward from said lower surface, forward ends of said slots being spaced inwardly a selected distance from said forward surface, said slots receiving securably therein vertical body sections of contact members extending vertically from selected sides of horizontal body sections thereof, said horizontal body sections being disposed adjacent a respective one of said upper and said lower surfaces after receipt into respective said slots, said spring arm contact sections extending forwardly from said horizontal body sections and projecting forwardly of said forward surface of said block.

18. A contact spacing means as set forth in claim 17 wherein said block has shallow recesses in said upper and said lower surfaces within which said horizontal body sections of said contact members are disposed.

19. A contact spacing means as set forth in claim 17 wherein said vertical slots alternatingly extend downward from said upper surface and upward from said lower surface.

20. A contact spacing means as set forth in claim 17 wherein at least one of said vertical slots is in communication with said rearward surface of said block such that a conductor-connecting section of an associated at least one said contact member extends rearwardly from said vertical body sections thereof and projects rearwardly from said rearward surface of said block.

21. A contact spacing means as set forth in claim 17 wherein at least one of said selected ones of said vertical slots is in communication with said lower surface of said block such that a portion of said vertical body section of an associated contact member projects downwardly from said lower surface.

22. A contact spacing means as set forth in claim 17 wherein an assembly of said block and said contact members is secured witin a dielectric housing means.

23. A contact spacing means as set forth in claim 17 wherein said contact members are secured within respective said vertical slots by barb-like projections on said vertical body sections of said contact members engaging associated sides of said vertical slots to resist outward movement of said contact members.

24. An electrical contact member securable in a slot of a dielectric spacing means and having a conductor-connecting section, a body means and a contact section, wherein said body means consists essentially of a horizontal body section and a vertical body section extending vertically from a selected longitudinal side of said horizontal body section, said contact section extending integrally forwardly from said horizontal body section, and said vertical body section being securable in an associated said slot of said spacing means.

25. An electrical contact member as set forth in claim 24 wherein said vertical body section has barb-like projections extending outwardly therefrom to engage an associated side of said associated vertical slot to resist outward movement of said contact member and secure said contact member within said slot.

26. An electrical contact member as set forth in claim 24 wherein said conductor-connecting section extends from one of said vertical body section and said horizontal body section for being terminated to an electrical conductor.

27. An electrical contact member as set forth in claim 26 wherein said conductor-connecting section includes a ferrule having a groove therealong to receive a said conductor therein to be terminated thereto for welding.

28. An electrical contact member as set forth in claim 27 wherein said welding is laser welding and said conductor is disposed in said groove in an interference fit therewith.

29. An electrical contact member as set forth in claim 24 wherein one of said vertical body section and said horizontal body section has a tab projecting therefrom to be connected to a ground plane.

* * * * *